US010760276B2

(12) United States Patent
Lindl

(10) Patent No.: US 10,760,276 B2
(45) Date of Patent: Sep. 1, 2020

(54) APPARATUS AND METHODS FOR CLEANING GUTTERS

(71) Applicant: LINDL&DODGE LLC, Billings, MT (US)

(72) Inventor: James R. Lindl, Knoxville, TN (US)

( * ) Notice: Subject to any disclaimer, the term of this patent is extended or adjusted under 35 U.S.C. 154(b) by 38 days.

(21) Appl. No.: 16/215,218

(22) Filed: Dec. 10, 2018

(65) Prior Publication Data

US 2020/0181915 A1 Jun. 11, 2020

(51) Int. Cl.
*E04D 13/076* (2006.01)
*B08B 9/00* (2006.01)
*B08B 5/02* (2006.01)

(52) U.S. Cl.
CPC ..... *E04D 13/0765* (2013.01); *B08B 5/02* (2013.01); *B08B 9/00* (2013.01)

(58) Field of Classification Search
None
See application file for complete search history.

(56) References Cited

U.S. PATENT DOCUMENTS 2,630,907 A * 3/1953 Miller ..... A01K 1/0146 198/318
3,286,314 A * 11/1966 Oetiker ..... B21D 53/16 24/20 R
4,750,883 A * 6/1988 Drake ..... A47L 11/38 134/167 C
5,022,586 A * 6/1991 Putnam ..... B05B 13/0436 239/71
2005/0115766 A1* 6/2005 Corston ..... E06C 7/46 182/107
2008/0163561 A1* 7/2008 Lenney ..... E04D 13/076 52/12
2017/0191272 A1* 7/2017 Ashton-Miller .... E04D 13/0765

* cited by examiner

*Primary Examiner* — Eric W Golightly
(74) *Attorney, Agent, or Firm* — Law Offices of Michael L. Wise, LLC

(57) ABSTRACT

An apparatus includes rigid tubing and a tubular nozzle. The tubular nozzle is attached to the rigid tubing and includes a proximal nozzle portion, a distal nozzle portion, and a guide-shoe. The proximal nozzle portion defines a first proximal nozzle sub-portion merging with a second proximal nozzle sub-portion at a first angle. The distal nozzle portion is removably attached to the proximal nozzle portion and defines a first distal nozzle sub-portion merging with a second distal nozzle sub-portion at a second angle. The guide-shoe projects outwardly from an exterior sidewall of the distal nozzle portion. In use, high-velocity air is propelled through the tubular nozzle to remove debris from the gutter. The guide-shoe allows the tubular nozzle to easily bypass hangers that are located in the gutter and to lock the tubular nozzle in the gutter so that it does not unintentionally depart the gutter.

17 Claims, 9 Drawing Sheets

Fig. 3
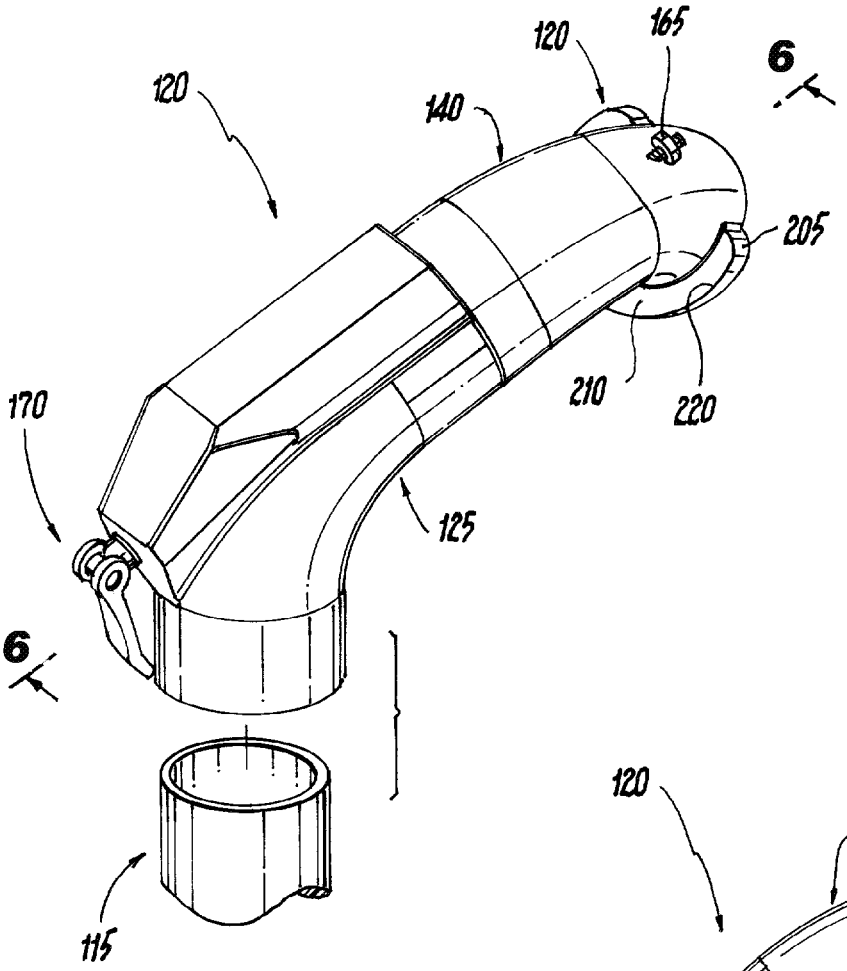
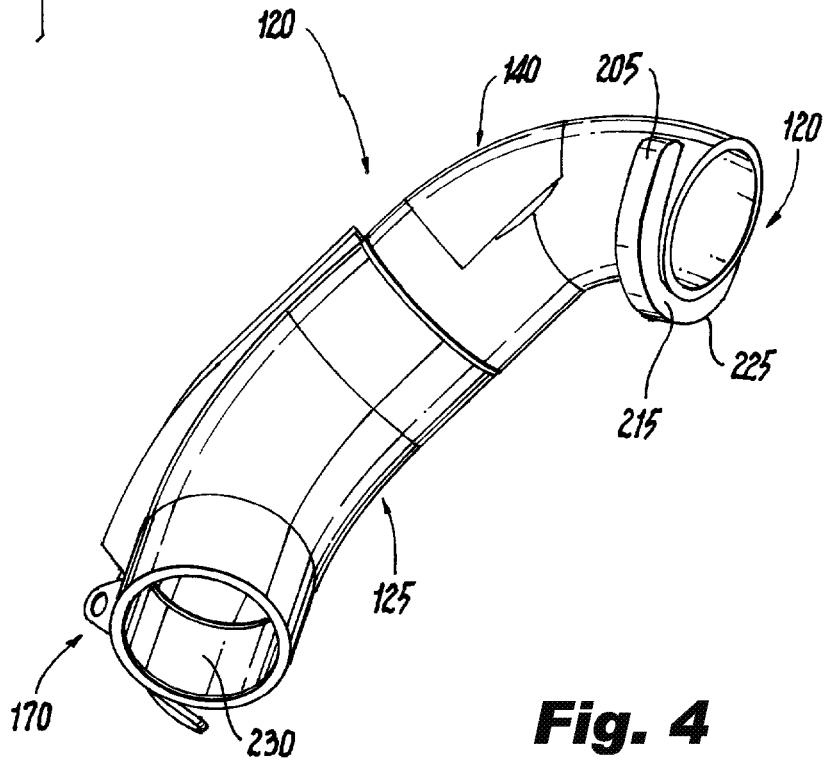
Fig. 4

Fig. 5
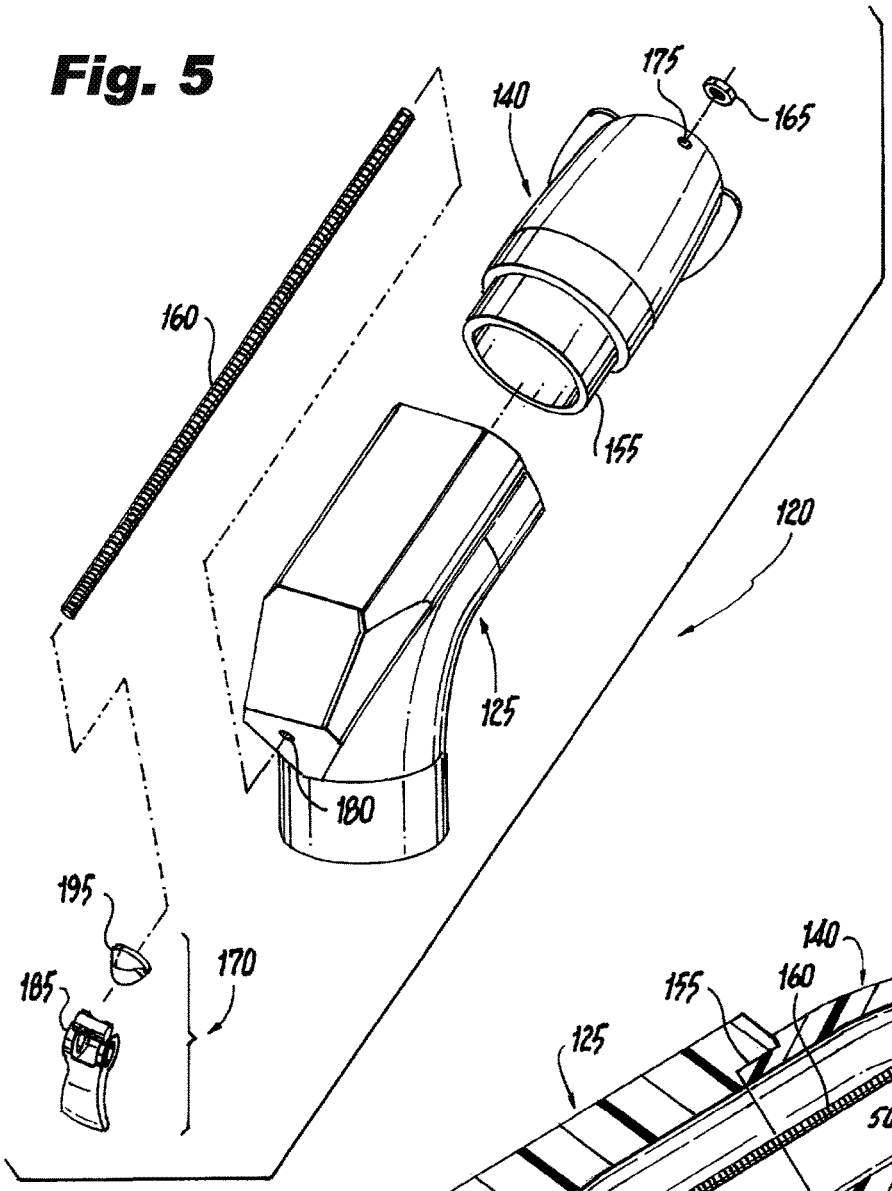
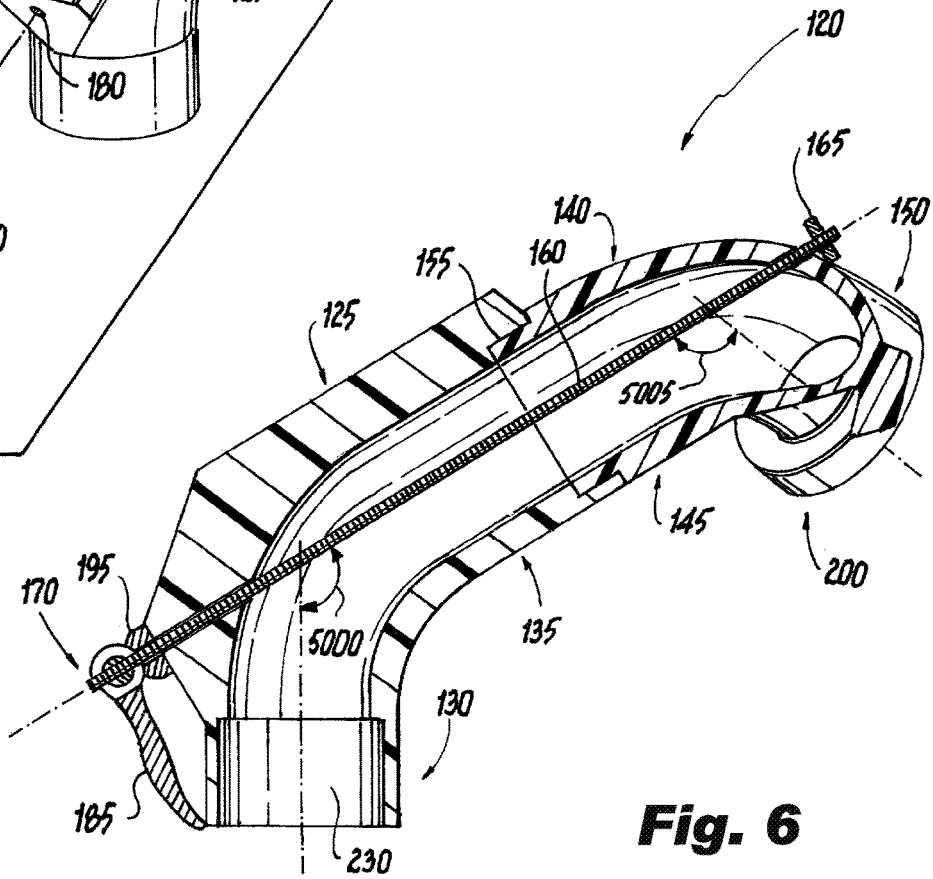
Fig. 6

APPARATUS AND METHODS FOR CLEANING GUTTERS

FIELD OF THE INVENTION

The present invention relates generally to cleaning means, and, more particularly, to apparatus and methods for cleaning debris from gutters.

BACKGROUND OF THE INVENTION

While cleaning house gutters of leaves and other debris remains a task that few look forward to doing, failure to do so can cause major issues for a home. Blockages can, for example, cause water to pour over the sides of a gutter and pool around the foundation of the house. This water can cause the foundation to crack and can lead to the growth of mold. In colder weather, a blocked gutter can form an ice dam, a ridge of ice that forms at the edge of a roof and prevents melting snow from draining off the roof. The backed-up water can eventually leak into the home, causing damage to walls, ceilings, insulation, and other areas.

Gutters are conventionally cleaned by getting on a ladder and manually removing the debris. Unfortunately, falls from ladders are quite common, and hundreds of injuries and deaths result every year as a result. Solutions that do not require accessing a gutter by ladder typically involve attaching long tubular attachments to leaf blowers, dry vacuums, or pressure washers. However, these attachments remain difficult to use. Almost all gutters include hangers (e.g., bracket hangers, spike-and-ferrule hangers) that transversely span the gutters at regular intervals and act to attach the gutters to their roofs. Conventional attachments get hung-up on these hangers. As a result, the nozzle-end of an attachment must be essentially lifted out of a gutter every time one of these hangers is encountered and then replaced back into the gutter after the hanger is traversed. Such repeated manipulations can be difficult when controlling the distal end of the attachment from the ground via a long run of tubing.

For the foregoing reasons, there is a need for new apparatus and methods that allow gutters to be effectively cleaned in an easy and safe manner while addressing the above-identified deficiencies associated with already-existing solutions.

SUMMARY OF THE INVENTION

Embodiments of the present invention address the above-identified needs by providing apparatus and methods for cleaning gutters.

Aspects of the invention are directed to an apparatus comprising rigid tubing and a tubular nozzle. The tubular nozzle is attached to the rigid tubing and comprises a proximal nozzle portion, a distal nozzle portion, and a guide-shoe. The proximal nozzle portion defines a first proximal nozzle sub-portion merging with a second proximal nozzle sub-portion at a first angle. The distal nozzle portion is removably attached to the proximal nozzle portion and defines a first distal nozzle sub-portion merging with a second distal nozzle sub-portion at a second angle. The guide-shoe projects outwardly from an exterior sidewall of the distal nozzle portion.

Additional aspects of the invention are directed to a method of cleaning gutters. An apparatus is obtained that comprises rigid tubing, a tubular nozzle attached to the rigid tubing, a blower, and flexible tubing spanning between the blower and the rigid tubing. The tubular nozzle comprises a proximal nozzle portion, a distal nozzle portion, and a guide-shoe. The proximal nozzle portion defines a first proximal nozzle sub-portion merging with a second proximal nozzle sub-portion at a first angle. The distal nozzle portion is removably attached to the proximal nozzle portion and defines a first distal nozzle sub-portion merging with a second distal nozzle sub-portion at a second angle. The guide-shoe projects outwardly from an exterior sidewall of the distal nozzle portion. In the cleaning method, the tubular nozzle is placed proximate to the gutter. Air is propelled from the blower through the flexible tubing, the rigid tubing, and the tubular nozzle into the gutter.

BRIEF DESCRIPTION OF THE DRAWINGS

These and other features, aspects, and advantages of the present invention will become better understood with regard to the following description, appended claims, and accompanying drawings where:

FIG. 3 shows a top perspective view of the tubular nozzle in the FIG. 1 apparatus;

FIG. 4 shows a bottom perspective view of the tubular nozzle in the FIG. 1 apparatus;

FIG. 5 shows a top exploded perspective view of the tubular nozzle in the FIG. 1 apparatus;

FIG. 6 shows a sectional view of the tubular nozzle in the FIG. 1 apparatus;

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

As used herein and in the appended claims, "substantially" means within plus or minus ten degrees. "Directly" means without an intervening element. An "angle" is meant to mean a non-linear angle. A surface is "curved planar" if the curvature may be conceptually removed from the surface to yield a flat surface without the need to conceptually cut, fold, overlap, or otherwise modify the surface beyond removing its curvature.

Figure 1:
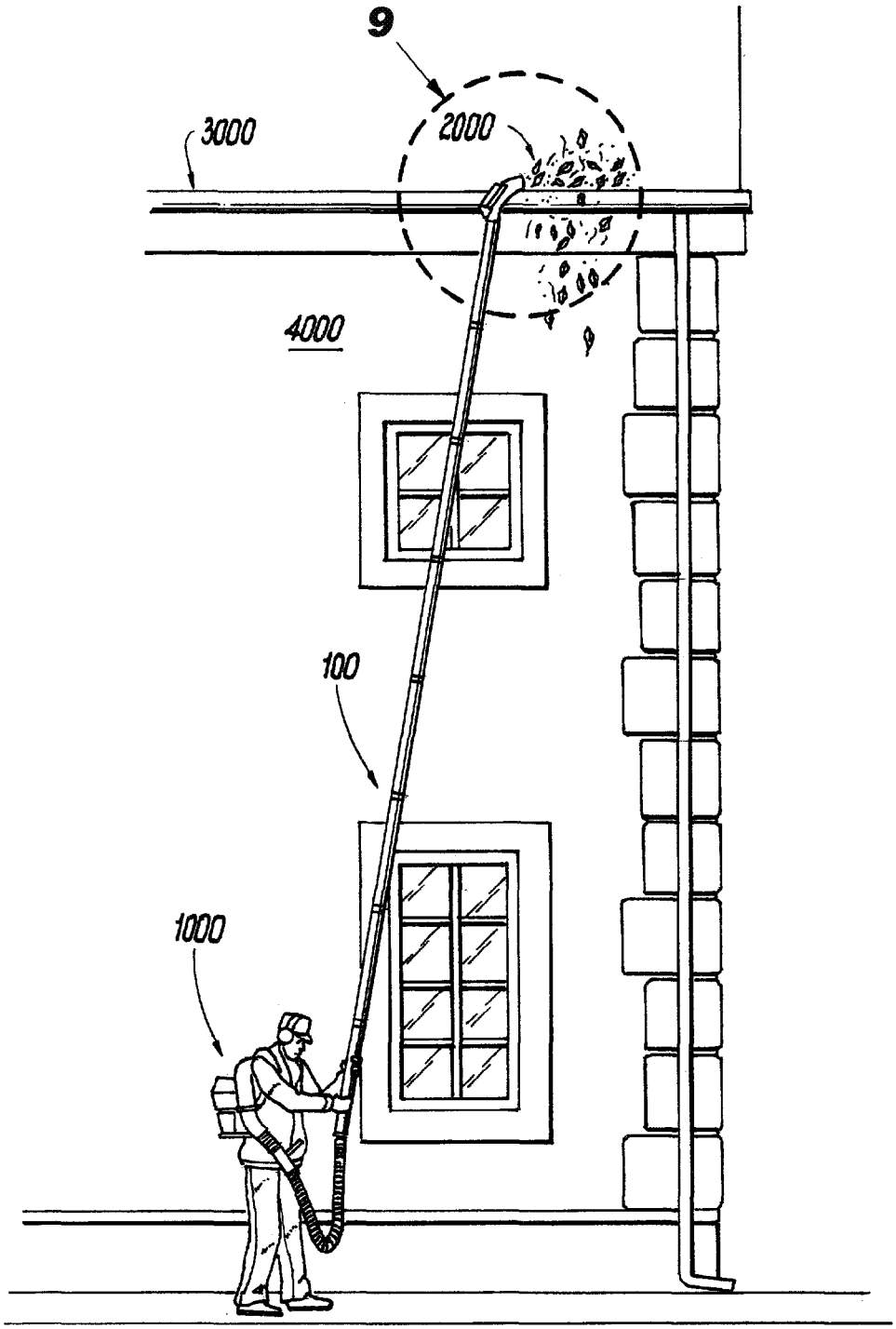
FIG. 1 shows a perspective view of a user using an apparatus in accordance with an illustrative embodiment of the invention to remove debris from a gutter attached to a two-story building.

Aspects of the invention are directed to an apparatus 100 for removing leaves and other debris from rain gutters associated with buildings. FIG. 1 shows a perspective view of a user 1000 using the apparatus 100 to remove debris 2000 from a gutter 3000 attached to a two-story building 4000. The apparatus 100 allows the user 1000 to propel pressurized air into the gutter 3000 to cause the debris 2000 therein to be expelled from the gutter 3000 and to fall to the ground. There, it can be safely collected and discarded. The gutter 3000 is thereby cleaned while the user 1000 stays safely on the ground, and issues associated with blockages are avoided by effectively cleaning the gutter 3000.

Figure 2:
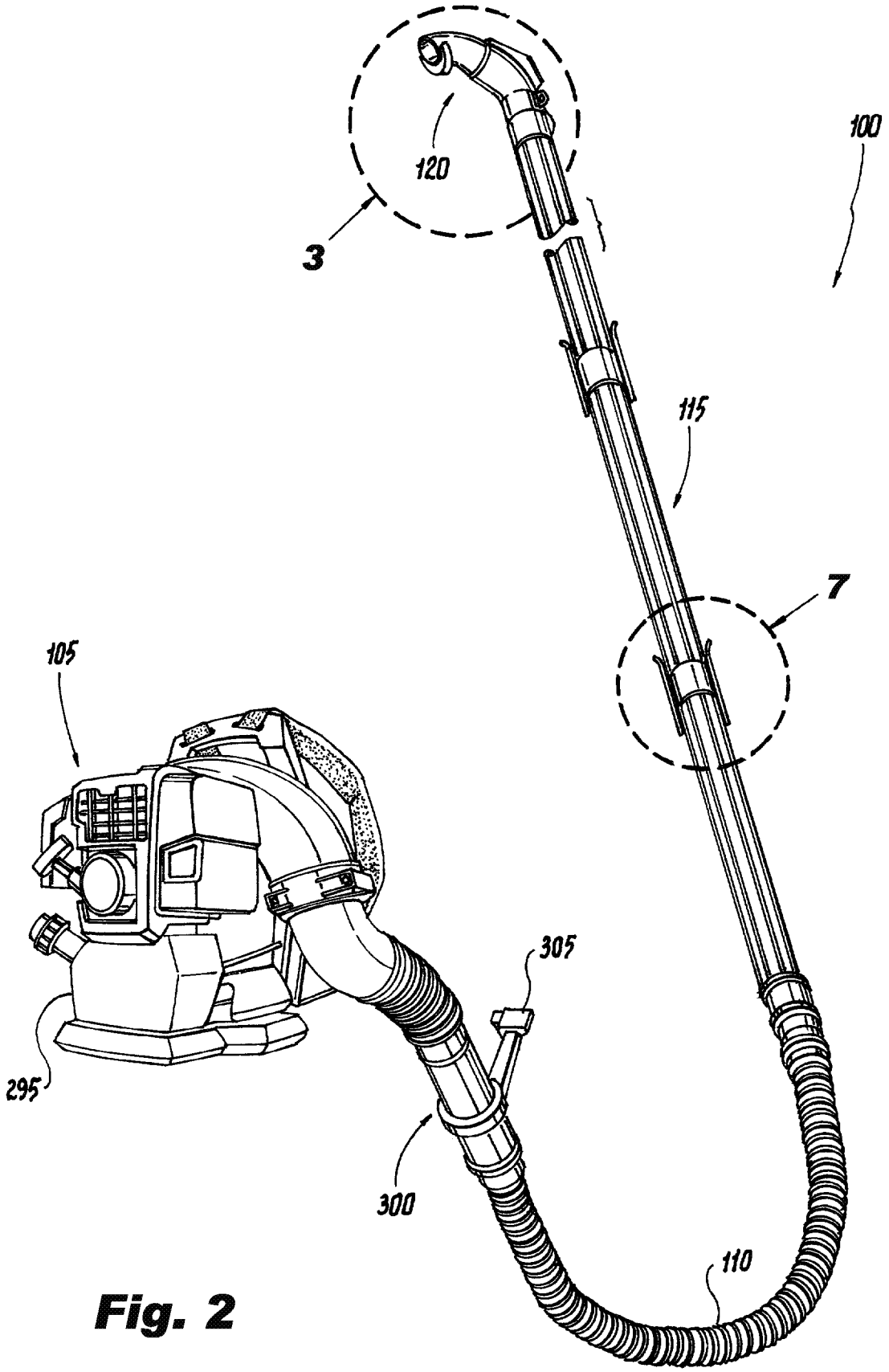
FIG. 2 shows a perspective view of the FIG. 1 apparatus alone.

Additional details of the illustrative apparatus 100 shown in FIG. 1 are shown in FIG. 2, which shows a perspective view of the apparatus 100 alone without other added elements. The apparatus 100 comprises: a blower 105, flexible tubing 110, rigid tubing 115, and a tubular nozzle 120. The tubular nozzle 120 is attached to the rigid tubing 115, which, in turn, is connected to the flexible tubing 110. The flexible tubing 110 is attached to an output of the blower 105 so as to span between the flexible tubing 110 and the rigid tubing 115. So configured, an interior of the tubular nozzle 120 is in gaseous communication with an interior of the rigid tubing 115 and an interior of the flexible tubing 110. The blower 105 is thereby able to propel high-velocity air through the flexible tubing 110, the rigid tubing 115, and out the tubular nozzle 120.

The tubular nozzle 120 has very novel characteristics that help it to effectively serve its function in cleaning gutters. FIGS. 3-6 help to illustrate some of these novel characteristics, with FIG. 3 showing a top perspective view of the tubular nozzle 120 in association with a top of the rigid tubing 115, FIG. 4 showing a bottom perspective view of the tubular nozzle 120, FIG. 5 showing a top exploded perspective view of the tubular nozzle 120, and FIG. 6 showing a sectional view of the tubular nozzle 120 along the cleave plane indicated in FIG. 3.

The tubular nozzle 120 can be conceptually broken down into several portions and sub-portions. A proximal nozzle portion 125 defines a first proximal nozzle sub-portion 130 that merges with a second proximal nozzle sub-portion 135 at a first angle 5000. At the same time, a distal nozzle portion 140 defines a first distal nozzle sub-portion 145 that merges with a second distal nozzle sub-portion 150 at a second angle 5005. Both angles 5000, 5005 are diagrammatically represented in FIG. 6.

The distal nozzle portion 140 is removably attached to the proximal nozzle portion 125. More particularly, the distal nozzle portion 140 defines an insertable region 155 that may be inserted into the distal nozzle portion 140. At the same time, a threaded rod 160, a nut 165, and a clamping handle 170 are implemented to draw the two nozzle portions 125, 140 together. A distal end of the threaded rod 160 emerges from a distal hole 175 in the distal nozzle portion 140 and terminates in the nut 165. A proximal end of the threaded rod 160 emerges from a proximal hole 180 in the proximal nozzle portion 125 and is threaded into the clamping handle 170, which includes a handle portion 185 and a threaded contact plate 195. The threaded rod 160 thereby spans between the distal nozzle portion 140 and the proximal nozzle portion 125. Threading the threaded rod 160 into the clamping handle 170 (i.e., engaging the threaded rod 160 with the clamping handle 170) and then rotating the handle portion 185 into its downward position causes an eccentric cam in the clamping handle 170 to place a tensional force on the threaded rod 160. This tensional force acts to draw the proximal and distal nozzle portions 125, 140 together.

In addition to holding the proximal and distal nozzle portions 125, 140 together, the above-described threaded-rod drawing means also allows the orientation of the distal nozzle portion 140 to be quickly modified in relation to the proximal nozzle portion 125. Such a modification can be accomplished by manually raising the clamping handle 170 to relieve some of the tension on the threaded rod 160, and then rotating the distal nozzle portion 140 relative to the proximal nozzle portion 125 about a rotational axis that is colinear with the threaded rod 160. Once the desired orientation is reached, the clamping handle 170 can again be rotated downward to reapply the requisite tensional force on the threaded rod 160. In this manner the distal nozzle portion 140 may be removably attached to the proximal nozzle portion 125 with a plurality of different orientations therebetween.

In addition to the above-described elements, the tubular nozzle 120 further includes a unique guide-shoe 200, clearly visible in FIGS. 3-6. The guide-shoe 200 projects outwardly from an exterior sidewall of the distal nozzle portion 140. In the present, non-limiting embodiment, the guide-shoe 200 is u-shaped and is attached to the distal nozzle portion 140 of the tubular nozzle 120 proximate to an output end of the tubular nozzle 120 (i.e., the end furthest from where the tubular nozzle 120 attaches to the rigid tubing 115). The guide-shoe 200 defines three exposed surfaces: a curved planar surface 205, a first flat sidewall 210, and a second flat sidewall 215. The curved planar surface 205 and the first flat sidewall 210 form a first curved edge 220, and the curved planar surface 205 and the second flat sidewall 215 form a second curved edge 225.

The tubular nozzle 120 is attached to a top of the rigid tubing 115 via a larger-diameter section 230 defined by the proximal nozzle portion 125 that slides over the top of the rigid tubing 115. The larger-diameter section 230 of the tubular nozzle 120 is preferably sized to create a tight compression fit between the two elements 115, 120. One or more rivets or other fixation means (e.g., screws, adhesives, etc.) may also be utilized to hold the two elements 115, 120 together, if additional fixation is desired.

As indicated above, the tubular nozzle 120 comprises two fixed curves with the first angle 5000 defined by the proximal nozzle portion 125, and the second angle 5005 defined by the distal nozzle portion 140 (FIG. 6). Extensive experimentation with prototypes of the apparatus 100 have suggested that the first angle 5000 preferably be between about 55 degrees and 65 degrees. The second angle 5005 is preferably between about 60 degrees and 70 degrees. These angles help to allow the user 1000 to easily obtain a comfortable position on the ground while utilizing the apparatus 100 in the manner detailed below (including implementing the tubular nozzle's various orientations relative to a gutter, again, detailed below). At the same time, these angles are gentle enough to minimize the flow resistance of the high-velocity air passing through the tubular nozzle 120, while correspondingly also reducing the reaction force acting on the tubular nozzle 120 from the high-velocity air passing therethrough. Less reaction force is thereby transmitted from the tubular nozzle 120 through the rigid tubing 115 to the user 1000.

Figure 7:
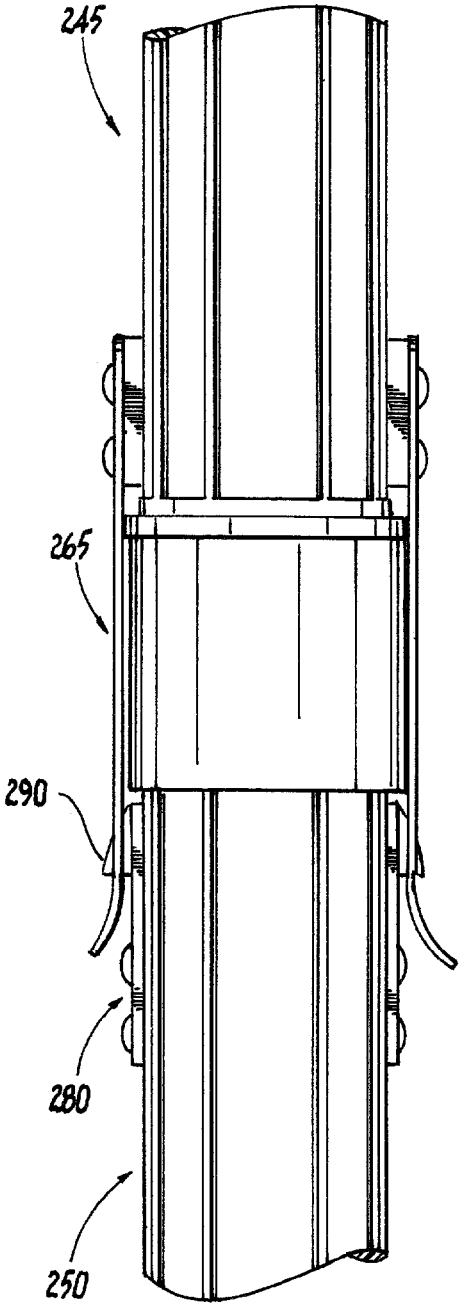
FIG. 7 shows a side view of tubing subsections in the FIG. 1 apparatus.
Figure 8:
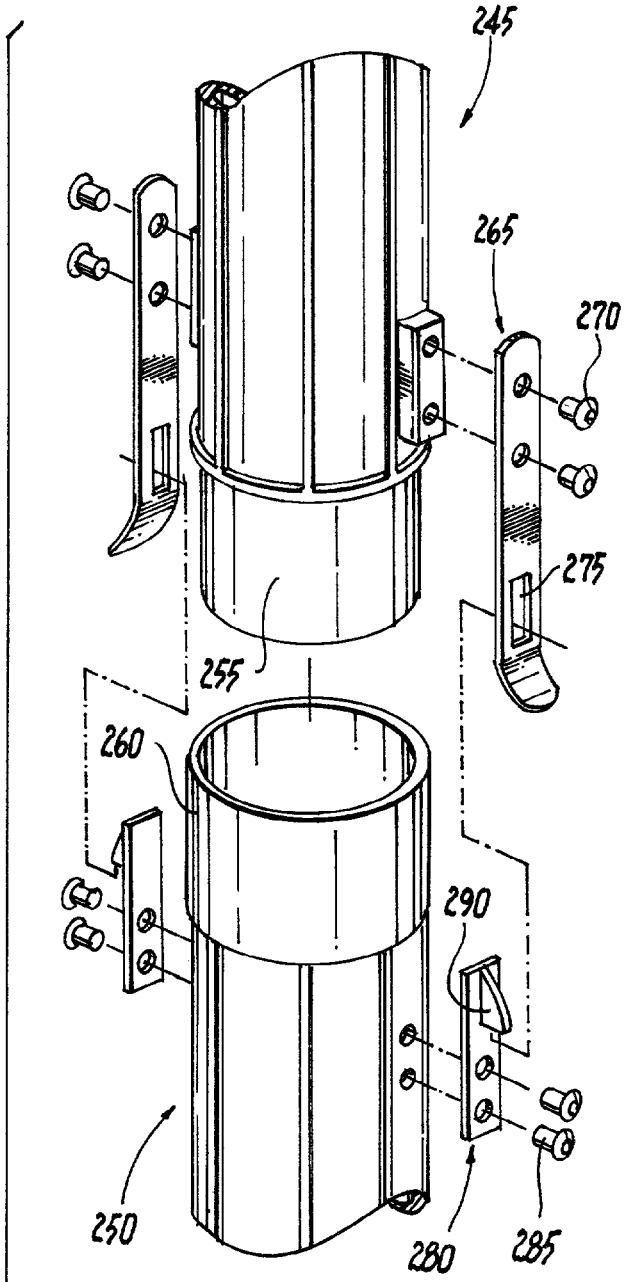
FIG. 8 shows an exploded perspective view of the FIG. 7 elements.
Figure 9:
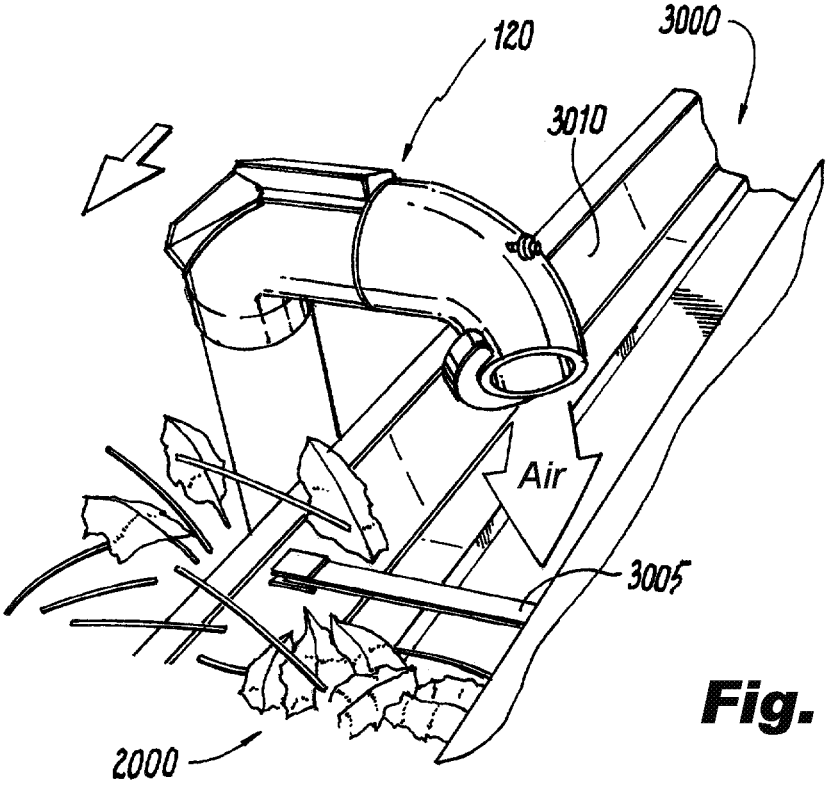
FIGS. 9-12 show a sequence of perspective views of the tubular nozzle in the FIG. 1 apparatus actively cleaning the gutter, with FIG. 11 showing a magnified perspective view of the tubular nozzle in the region indicated in FIG. 10.

Like the tubular nozzle 120, the rigid tubing 115 also comprises sub-parts. More particularly, the rigid tubing 115 is formed of a plurality of removably joined subsections, which allow the effective overall length of the rigid tubing 115 to be modified to meet different applications while, at the same time, allowing the rigid tubing 115 to be transported and stored in a more compacted form. FIG. 7 shows a side view of a first rigid tubing subsection 245 removably joined to a second rigid tubing subsection 250, while FIG. 8 shows an exploded side perspective view of the same elements. The first rigid tubing subsection 245 comprises a smaller-diameter region 255 which slides into (i.e., nests into) a larger-diameter region 260 of the second rigid tubing subsection 250. At the same time spring-steel strips are used to hold the two rigid tubing subsections 245, 250 together. The first rigid tubing subsection 245 includes two first strips 265 attached by first rivets 270 to opposed sides of an exterior surface of the first rigid tubing subsection 245. Each of the first strips 265 defines a respective slot 275 and is curved at one end. The second rigid tubing subsection 250 includes two second strips 280 attached by second rivets 285 to opposed sides of an exterior surface of the second rigid tubing subsection 250. Here, each of the second strips 280 defines a respective tab 290. When the first rigid tubing subsection 245 is slid into the second rigid tubing subsection 250, the first strips 265 slide over the second strips 280 and ultimately the tabs 290 engage the slots 275 to firmly lock the two rigid tubing subsections 245, 250 together. Disengagement of the two rigid tubing subsections 245, 250 is as easy as lifting on the curved parts of the first strips 265 to disengage the tabs 290 from the slots 275, and then pulling the two rigid tubing subsections 245, 250 apart. In this manner, constructing the rigid tubing 115 and putting it away in a more compacted form after use may readily be performed manually (i.e., without the use of tools).

The blower 105 may comprise any type of equipment capable of providing a source of high-velocity air, such as a conventional leaf blower or a shop vacuum that is capable of blowing in addition to providing a vacuum. The blower 105 in FIG. 1, for example, is part of a conventional gas-operated backpack leaf blower, which includes a back unit 295 that provides high-velocity air to a wand assembly 300 (FIG. 1). The wand assembly 300 includes a throttle 305 for modulating the blower 105. The wand assembly 300 is attached to the flexible tubing 110 in a manner that puts both elements into gaseous communication with each other.

In use, the user 1000 may stand safely on the ground next to the building 4000 and place the tubular nozzle 120 proximate to the gutter 3000 to be cleaned. Sufficient numbers of subsections of rigid tubing 115 may be joined to reach gutters associated with the building being cleaned. The user 1000 may then command the blower 105 to propel high-velocity air through the tubular nozzle 120 while manipulating the tubular nozzle 120 in the gutter 3000 to cause debris 2000 therein to be expelled. During use, the user 1000 may grasp the rigid tubing 115 in order to manipulate the tubular nozzle 120 while allowing the flexible tubing 110 to drape (i.e., span) between the user 1000 and the rigid tubing 115 (FIG. 1).

Effective gutter cleaning may be accomplished by walking the tubular nozzle 120 forward along the gutter 3000 from a starting point in a single direction and then, if it is felt that the gutter 3000 would benefit from another pass, resetting the tubular nozzle 120 back to the starting point so the process can be repeated. Moving the tubular nozzle 120 in the single direction involves moving the nozzle in what will hereinafter be called the "forward cleaning direction." Resetting the tubular nozzle 120 involves sliding the tubular nozzle 120 back to the starting point in a direction opposite the forward cleaning direction in what is hereinafter called the "reverse resetting direction." Notably, the tubular nozzle 120 is designed to be oriented in two different orientations with respect to the gutter 3000 when moving in the forward cleaning direction and the reverse resetting direction; a "forward cleaning orientation" is associated with the forward cleaning direction, while a "reverse resetting orientation" is associated with the reverse resetting direction. The functionality of each orientation will now be described in detail.

Figure 10:
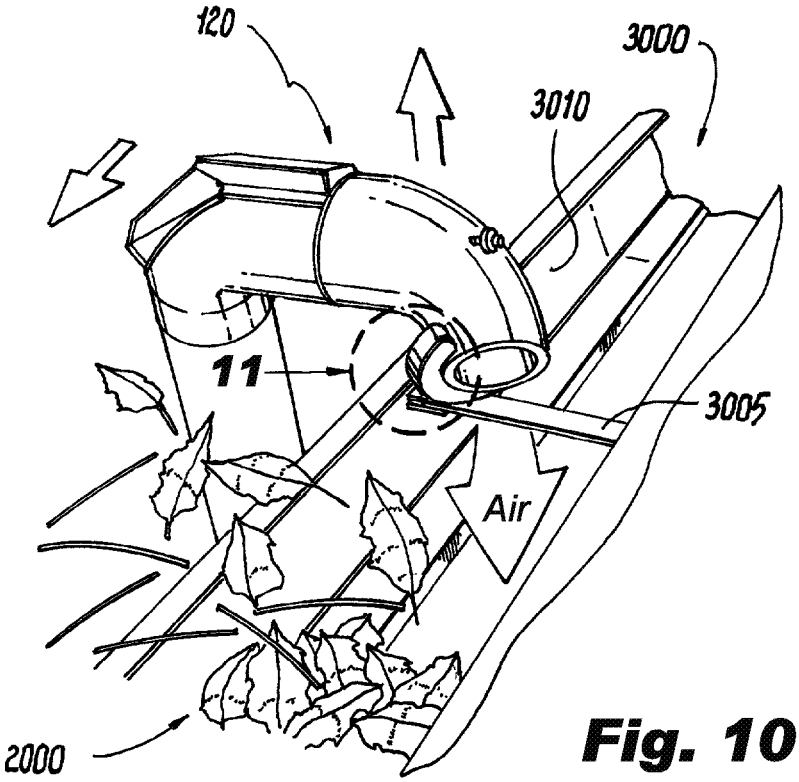
Figure 11:
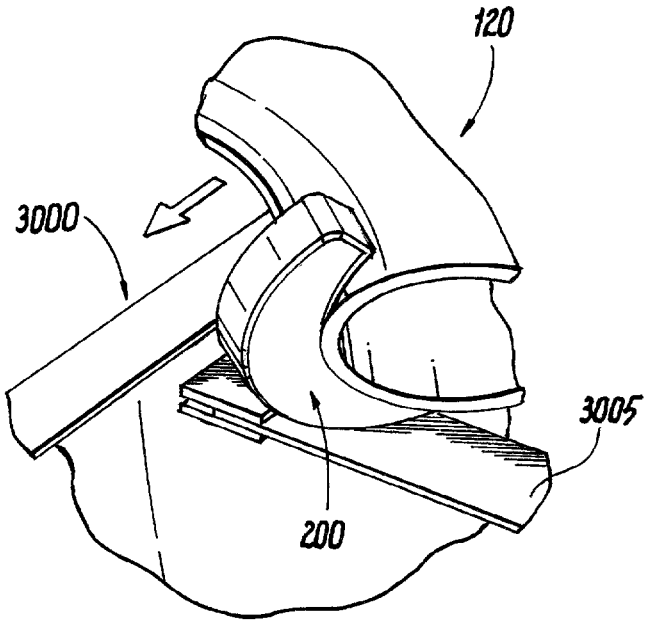

FIGS. 9-12 show a sequence of perspective views of the tubular nozzle 120 actively cleaning the gutter 3000, with FIG. 11 showing a magnified perspective view of the tubular nozzle 120 in the region indicated in FIG. 10. In these figures the tubular nozzle 120 is being walked forward by the user 1000 in the forward cleaning direction while the tubular nozzle 120 is oriented in its forward cleaning orientation. The gutter 3000 includes hangers 3005 spaced at regular intervals.

As indicated in the Background Section, most gutters include hangers (e.g., bracket hangers, spike-and-ferrule hangers) that transversely span the gutters at regular intervals and act to attach the gutters to their roofs. Conventional attachments get hung-up on these hangers. As a result, the nozzle-end of a conventional attachment must be essentially lifted out of a gutter every time one of these hangers is encountered, and then replaced back into the gutter after the hanger is traversed. Such repeated manipulations can be difficult and fatiguing when controlling the distal end of the attachment from the ground via a long run of tubing. Advantageously the tubular nozzle 120 in the illustrative apparatus 100 addresses these shortcomings.

Now referring to FIG. 9-12, the tubular nozzle 120 in the forward cleaning orientation is positioned in the gutter 3000 such that air propelled from the tubular nozzle 120 is directed into the gutter 3000 so as to push the debris 2000 in the gutter 3000 forward and out of the gutter 3000 away from the tubular nozzle 120. At the same time, the unique guide-shoe 200 of the tubular nozzle 120 makes contact with an outside sidewall 3010 (i.e., outside rail) of the gutter 3000. This contact locks the tubular nozzle 120 in the gutter 3000 and reduces the chance that the tubular nozzle 120 will depart the gutter 3000 in response to the reaction force of the high-velocity air being expelled by the tubular nozzle 120.

Figure 12:
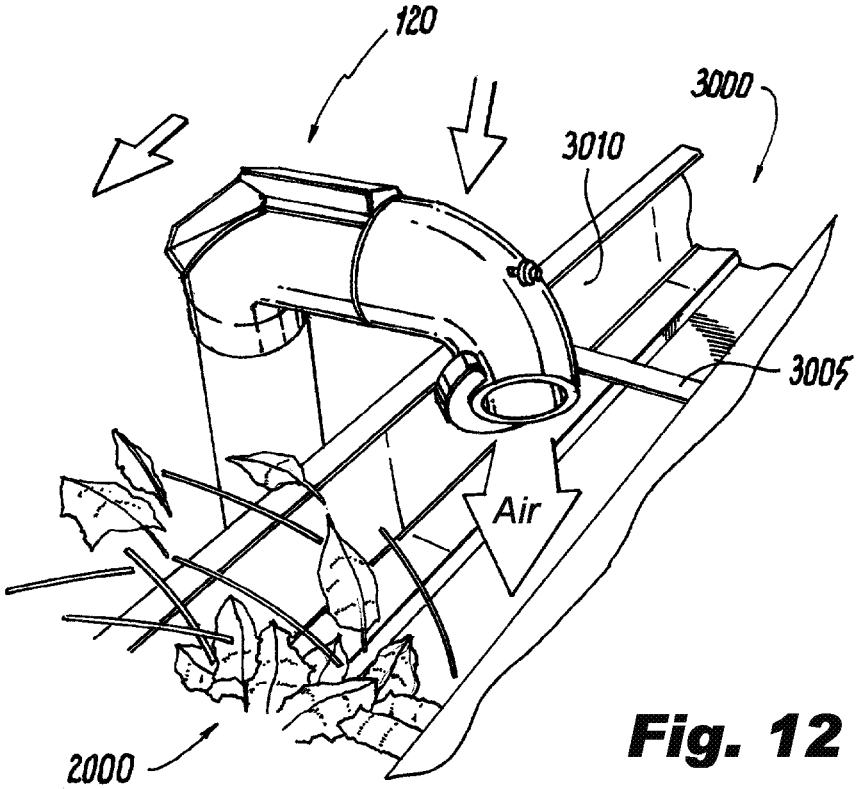

When coming upon a hanger 3005, the guide-shoe 200 makes contact with the hangar, and due to the curvature of the guide-shoe 200, translates the forward motion of the tubular nozzle 120 into vertical motion that allows the tubular nozzle 120 to readily traverse the hanger 3005. As the hanger 3005 is encountered, an initial upward motion allows the tubular nozzle 120 to ride up and over the hanger 3005 (FIGS. 10 and 11), and, after the hanger 3005 is bypassed, a subsequent downward motion allows the tubular nozzle 120 to return more deeply into the gutter 3000 (FIG. 12). Thus, the unique guide-shoe 200 imparts vertical motion to the tubular nozzle 120 as hangers 3005 are encountered while moving the tubular nozzle 120 in the forward cleaning direction. During this transversal and while the guide-shoe 200 is imparting the vertical motion, the guide-shoe 200 remains firmly in contact with the outside sidewall 3010 of the gutter 3000, again assuring that the tubular nozzle 120 does not depart the gutter 3000 due to the thrust of the expelled air. Given these dynamics, all the user 1000 feels when the tubular nozzle 120 encounters a hanger 3005 is an almost imperceptible vertical motion of the tubular nozzle 120. The tubular nozzle 120 has no tendency to depart the gutter 3000 and the forward travel of the nozzle remains essentially unimpeded, even when encountering one hanger 3005 after the other.

Notably, the relative orientation of the distal nozzle portion 140 relative to the proximal nozzle portion 125 can also be altered as desired by the user 1000 when cleaning the gutter 3000 with the apparatus 100. Such a manual adjustment can be accomplished utilizing the combination of the threaded rod 160 and the clamping handle 170 in the manner set forth above. This ability to reorient the tubular nozzle 120 is a valuable added feature of the apparatus 100. The orientation may, for example, be quickly changed when reversing the forward cleaning direction relative to the gutter 3000. At the same time, because of the complicated geometry of the apparatus 100, variations in the user's position relative to the gutter 3000 tend to translate into variations in the incident angle of the tubular nozzle 120 on the gutter 3000. The ability to easily reorient the tubular nozzle 120 ensures that the user 1000 can achieve an effective forward cleaning orientation of the tubular nozzle 120 relative to the gutter 3000 in response to these variations.

Figure 13:
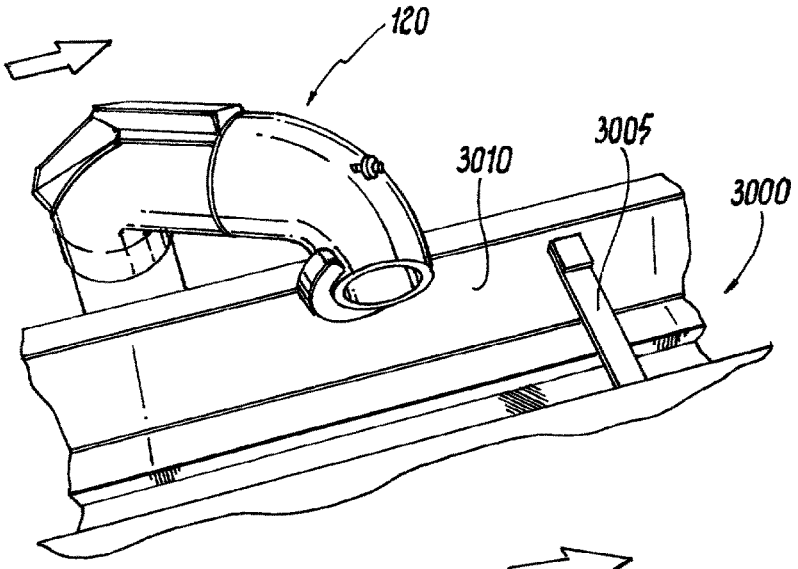
FIGS. 13-15 show a sequence of perspective views of the tubular nozzle in the FIG. 1 apparatus actively being reset in the gutter.
Figure 14:
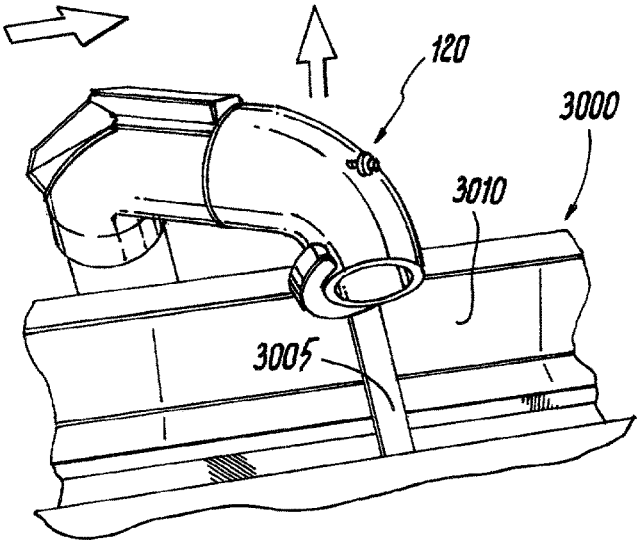
Figure 15:
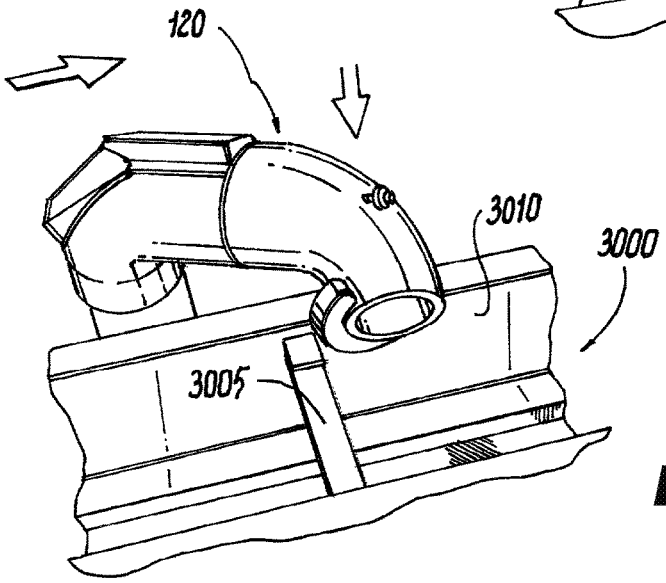

FIGS. 13-15 show a sequence of perspective views of the tubular nozzle 120 in its reverse resetting orientation relative to the gutter 3000, conducive to moving the nozzle in the reverse resetting direction. The user 1000 can readily transition the tubular nozzle 120 from the forward cleaning orientation to the reverse resetting orientation by merely twisting the rigid tubing 115 while still safely standing on the ground.

As was the case while the tubular nozzle 120 was in its forward cleaning orientation, the unique guide-shoe 200 both helps lock the tubular nozzle 120 into the gutter 3000 and helps the tubular nozzle 120 traverse hangers 3005 while the tubular nozzle 120 is in its reverse resetting orientation. In the reverse resetting orientation, the guide-shoe 200 remains in contact with the outside sidewall 3010 of the gutter 3000, inhibiting the tubular nozzle 120 from coming loose from the gutter 3000 (FIG. 13). At the same time, when a hanger 3005 is encountered (FIGS. 14 and 15), the shape of the guide-shoe 200 again imparts vertical motion to the rearward traveling tubular nozzle 120, which acts to lift the tubular nozzle 120 over the hanger 3005 and drop it back down into the gutter 3000 after the hanger 3005 is bypassed. Here again, the user 1000 feels very little resistance from the hanger 3005 as that user 1000 translates the tubular nozzle 120 back to its starting point on the gutter 3000. Notably, the reverse resetting orientation also provides a convenient means to statically "hang" the tubular nozzle 120 from the gutter 3000 when taking a pause in the cleaning process.

Thus, the above-described apparatus 100, and, more generally, apparatus in accordance with aspects of the invention, provide several advantages over preexisting gutter-cleaning solutions. In particular, the novel shape of the tubular nozzle 120 in combination with its unique guide-shoe 200 provides a means to effectively clean debris from gutters with regularly-spaced hangers without requiring a user to have to manually manipulate the nozzle passed each hanger as they are encountered. Instead, the apparatus 100 is configured to allow the tubular nozzle 120 to essentially slide over these hangers as a result of the vertical motion imparted by the guide-shoe 200 in a manner that is almost imperceptible to the user and while the tubular nozzle 120 remains solidly locked into the gutter. At the same time, aspects of the invention optimally direct a forward-facing source of high-velocity air directly into the gutter so maximum debris removal can be achieved.

The above-described means for joining subsections of rigid tubing 115 also provide advantages over prior art solutions such as simple, compression-based joining solutions. The spring-steel strips 265, 280 provide positive locking of one rigid tubing subsection to another, but, at the same time, also allow easy disassembly without the need for tools. In this manner, many subsections of rigid tubing may be readily brought to a job site and the ultimate length of rigid tubing tailored to the specific application. Once the job is completed, the run of rigid tubing can be broken back down to its compacted form for easy transport and storage.

Elements of the invention may be sourced from commercial vendors and/or manufactured using conventional manufacturing techniques that will be familiar to one having ordinary skill in the relevant arts. A suitable backpack leaf blower may be sourced from, for example, HUSQVARNA® PROFESSIONAL PRODUCTS INC. (Charlotte, N.C., USA). Flexible and rigid tubing (which may be modified with the above-described spring-steel strips) are commercially available from, for example, RIDGID® TOOL COMPANY (Elyria, Ohio, USA). Clamping handles (also called cam handles and clamping levers) capable of acting on threaded rod in the manner indicated above are commercially available from several different vendors, including, as just one example, MCMASTER-CARR® COMPANY (Elmhurst, Ill., USA).

A tubular nozzle suitable for use in embodiments of the invention may be formed of a plastic such as, but not limited to, polyvinyl chloride (PVC) using conventional manufacturing techniques. Conventional manufacturing techniques include injection molding, computer-numerical-control (CNC) machining, three-dimensional (3*d*) printing, and the like.

Figure 16:
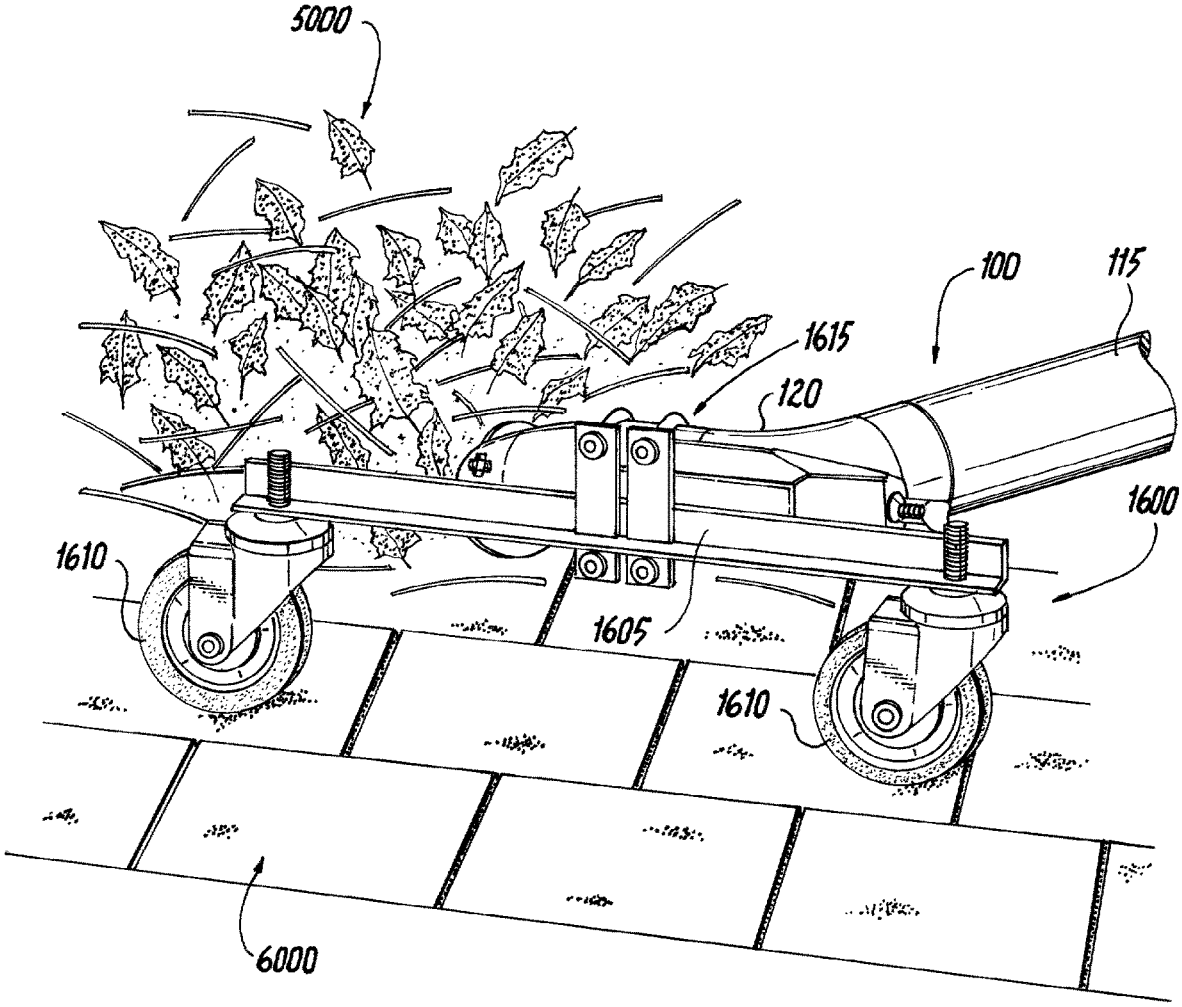
FIG. 16 shows a perspective view of the FIG. 1 apparatus in addition to an optional attachment in accordance with additional aspects of the invention while cleaning debris from a roof.

In one or more additional embodiments falling within the scope of the invention, an optional attachment may be added to the apparatus 100 to allow the apparatus 100 to clean roof surfaces in addition to gutters. Such an optional attachment is represented in FIG. 16, which shows a perspective view of the apparatus 100 in addition to an optional attachment 1600 while cleaning debris 5000 from a roof 6000. The optional attachment 1600 includes a frame 1605, a pair of casters 1610 attached at opposite ends of the frame, and two u-bolts 1615 that act to removably attach the optional attachment 1600 to the tubular nozzle 120 of the apparatus 100.

With the optional attachment 1600 in place, a user can sweep the tubular nozzle 120 across the roof 6000 while manipulating the tubular nozzle 120 via the rigid tubing 115. While performing the sweeping motion, high-velocity air from the tubular nozzle 120 can be used to direct the debris 5000 off the roof 6000. The apparatus 100 with the optional attachment 1600 thereby becomes a means to safely clean a rooftop associated with a building in addition to the building's gutters. The orientation of the tubular nozzle 120 relative to the frame 1605 and the casters 1610 can be altered to direct the output of the tubular nozzle 120 by simply loosening the u-bolts 1615, setting the desired orientation, and re-tightening the u-bolts 1615. If such changes of orientation are frequent, nuts on the u-bolts 1615 can be replaced with cam levers to facilitate loosening and tightening the u-bolts 1615 manually (i.e., without the need for tools).

It should again be emphasized that the above-described embodiments of the invention are intended to be illustrative only. Other embodiments can use different types and arrangements of elements for implementing the described functionality. These numerous alternative embodiments within the scope of the appended claims will be apparent to one skilled in the art.

All the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

Any element in a claim that does not explicitly state "means for" performing a specified function or "step for" performing a specified function is not to be interpreted as a "means for" or "step for" clause as specified in AIA 35 U.S.C. § 112(f). In particular, the use of "steps of" in the claims herein is not intended to invoke the provisions of AIA 35 U.S.C. § 112(f).

What is claimed is:

1. An apparatus comprising:

rigid tubing; and a tubular nozzle attached to the rigid tubing and comprising:

a proximal nozzle portion defining a first proximal nozzle sub-portion merging with a second proximal nozzle sub-portion at a first angle;

a distal nozzle portion removably attached to the proximal nozzle portion and defining a first distal nozzle sub-portion merging with a second distal nozzle sub-portion at a second angle, the second distal nozzle sub-portion terminating in a single tubular opening to the outside; and a guide-shoe projecting outwardly from an exterior sidewall of the single tubular opening.

2. The apparatus of claim 1, wherein an interior of the tubular nozzle is in gaseous communication with an interior of the rigid tubing.

3. The apparatus of claim 1, wherein the rigid tubing comprises a first rigid tubing subsection removably joined to a second rigid tubing subsection.

4. The apparatus of claim 3, wherein:

the first rigid tubing subsection comprises a first strip defining a slot;

the second rigid tubing subsection comprises a second strip defining a tab; and the tab engages the slot.

5. The apparatus of claim 4, wherein the first strip is at least partially curved.

6. The apparatus of claim 4, wherein the first strip comprises spring steel.

7. The apparatus of claim 1, wherein the guide-shoe is u-shaped.

8. The apparatus of claim 1, wherein the guide-shoe defines a curved planar outside surface.

9. The apparatus of claim 1, wherein the distal nozzle portion may be removably attached to the proximal nozzle portion with a plurality of different orientations therebetween.

10. The apparatus of claim 1, wherein the tubular nozzle further comprises a threaded rod spanning between the proximal nozzle portion and the distal nozzle portion.

11. The apparatus of claim 10, wherein the tubular nozzle further comprises a clamping handle engaged with the threaded rod.

12. The apparatus of claim 11, wherein actuating the clamping handle creates a tensional force on the threaded rod.

13. The apparatus of claim 1, wherein the first angle is between 55 and 65 degrees.

14. The apparatus of claim 1, wherein the second angle is between 60 and 70 degrees.

15. The apparatus of claim 1, further comprising:

a blower; and flexible tubing spanning between the blower and the rigid tubing;

wherein the blower is operative to propel air through the flexible tubing, the rigid tubing, and the tubular nozzle.

16. The apparatus of claim 15, wherein the blower comprises a portion of a backpack leaf blower.

17. The apparatus of claim 1, further comprising one or more casters attached to the tubular nozzle.

* * * * *